United States Patent [19]
Messineo et al.
[11] 4,202,269
[45] May 13, 1980

[54] FUZE MINE ANTI-PERSONNEL

[75] Inventors: Joseph R. Messineo, Paterson; George F. Lehwald, South Orange, both of N.J.

[73] Assignee: The United States of America as represented by the Secretary of the Army, Washington, D.C.

[21] Appl. No.: 767,490

[22] Filed: Oct. 15, 1958

[51] Int. Cl.[2] ..... F42B 23/10
[52] U.S. Cl. ..... 102/8; 102/17; 102/221
[58] Field of Search ..... 102/8, 17, 70, 16, 221, 102/5-7

[56] References Cited

U.S. PATENT DOCUMENTS 2,516,890 8/1950 Liljegren ..... 102/8 X

*Primary Examiner*—David H. Brown
*Attorney, Agent, or Firm*—Nathan Edelberg; Robert P. Gibson; Harold H. Card, Jr.

EXEMPLARY CLAIM

2. In an anti-personnel mine fuze, a body member having a cylindrical recess therein, an upstanding concentrical sleeve in said recess, a spring-loaded pressure plate slidable in said body and sleeve, firing mechanism for said fuze comprising a firing pin release having a socket in its lower portion and a cut away upper portion defining a planar vertical face, a track member secured to said planar face defining a pair of downwardly inclining parallel upper and lower tracks, a spring loaded firing pin slidable in said body and received in said socket in said firing pin release, detent means normally locking said firing pin in said socket, a spring held selector bar pivotally mounted in said pressure plate member and disposed normally above said track member and a pin fixed with the lower end of said bar adapted upon downward movement of said pressure plate member and said bar upon application of a predetermined personnel load thereon to rotate in a counter-clockwise manner and snap under said upper track on said track member in a clockwise direction whereby upon release of said personnel load on said plate, said firing pin release and said firing pin will be lifted to free said detent locking members therefrom and release said firing pin, but upon application of a load heavier than said personnel load on said plate, said selector bar will rotate to move said pin thereon completely around said track member in a clockwise manner to complete a non-functioning cycle and rearmament of said fuze.

3 Claims, 3 Drawing Figures

FUZE MINE ANTI-PERSONNEL

The invention described herein maybe manufactured and used by or for the Government for governmental purposes without the payment to us of any royalty thereon.

This invention relates to an anti-personnel mine fuze, and more particularly to a mine fuze which functions under personnel loads only; existing fuzes of this type usually function under personnel as well as tank or vehicular loads.

The present invention is designed to provide a mechanical means of discriminating between personnel and combat vehicle loads such that anti-personnel mine fields cannot be cleared by the passing of enemy combat vehicles or similar mine clearing equipment. The present invention is also designed to remain armed after the passing of combat vehicles, thus providing an effective weapon against its intended target, namely enemy personnel following these vehicles. With minor modification, the fuze will also provide a suitable fuzing mechanism for a pressure-release type booby trap.

Accordingly, it is a primary object of this invention to provide an improved anti-personnel mine fuze discriminating between personnel and combat vehicle loads.

It is another object to provide a fuze remaining armed after the passing of a combat vehicle thereover.

It is a further object to provide a fuze adaptable for use as a pressure release type booby trap.

It is a still further object of this invention to provide a fuze that is positive in action and economical in use due to its complete mechanical operation.

The specific nature of the invention as well as other objects and advantages thereof will clearly appear from a description of a preferred embodiment as shown in the accompanying drawing in which.

Figure 1:
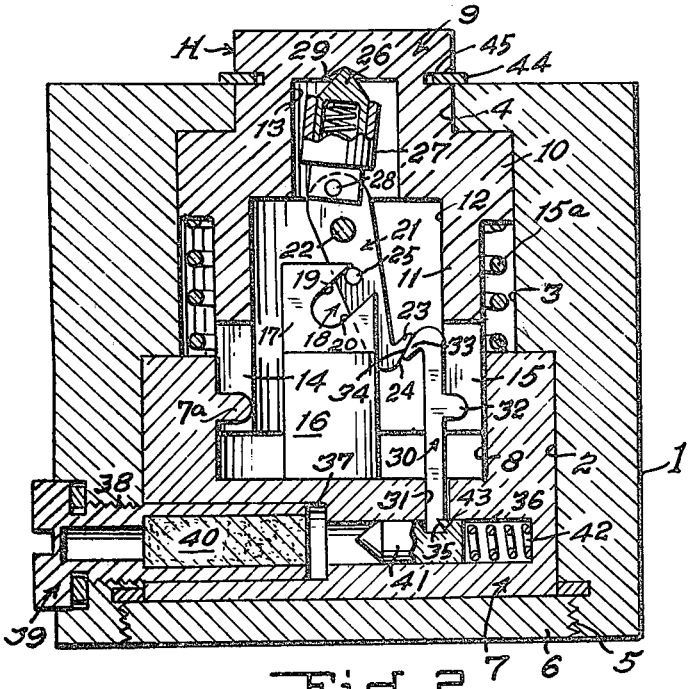
FIG. 1 is a cross sectional view of an anti-personnel mine fuze constructed in accordance with the invention.

Referring more particularly to the drawing in which similar reference characters refer to similar parts, in FIG. 1, 1 denotes a cylindrical fuze body having a central bore 2, and counter bores 3 and 4 receiving fuze operating mechanism therein. Below bore 2, there is provided a threaded opening 5 receiving a threaded closure member 6. A cylindrical body insert, generally indicated by 7, is disposed within bore 2 and is provided with a cylindrical recess 8. A cylindrical pressure plate member, generally indicated by 9 is provided with an intermediate portion 10 sliding in bore 3, an upwardly extending head portion H of less diameter than the intermediate portion slidable in bore 4 and a downwardly extending portion 11 slidable in recess 8 of the body insert 7. Pressure plate member 9 is provided with upwardly extending bores 12 and 13 for a purpose to be hereinafter described. Portion 11 is provided with a pair of diametrically opposed slots 14 and 15 in the lower/part thereof. Body insert 7, is provided with an integral lug $7^a$ adapted to project into slot 14 of portion 11 providing an anti-rotation means for pressure plate 9. Pressure plate 9 is normally biased in an upward direction from body insert 7 by a coil spring $15^a$ disposed about portion 11 of the pressure plate and biasing between portion 10 and the upper surface of body insert 7. An upstanding post 16 is integral to the bottom surface of recess 8 and is disposed substantially off-center thereto. The upper portion of 16 is cut away to provide a flat face 17 which is provided with an inclined cut, generally indicated by 18 and defines an upper inclined track 19 and a lower inclined track 20 in parallel relation to each other. A selector bar, generally indicated by 21 is pivotally mounted in bore 12 by a transverse shaft 22. The lower end of bar 21 is upturned at its lower end as at 23 and defines a beveled edge 24. A selector bar pin 25 spaced below shaft 22, projects laterally from bar 21 to normally engage the upper inclined track 19. A spring loaded detent 26 slidable in a housing 27 is pivotally mounted to the upper end of bar 21 by pin 28 and is received in a notch 29 provided in the upper end of bore 13.

A firing pin release member, indicated generally by 30 is slidably mounted for vertical movement in a bore 31 provided in the floor of recess 8 of body insert 7. Release member 30 is provided with an integral lug 32 which is adapted to ride in slot 15 of portion 11 of pressure plate 9 and serves as a guide for release member 30. Release member 30 is turned down at its upper end as at 33 and is provided with a beveled edge 34 normally in contact with beveled edge 24. The lower end of member 30 is notched to provide a beveled surface 35 for a purpose to be described as the description progresses.

Firing means are provided and are mounted in radial bores 36 and 37 in body insert 7 and a threaded bore 38 in body 1. A plug, generally indicated by 39 is threadably engaged in bore 38 and a portion carrying a detonating charge 40 extends into bore 37. A firing pin 41 is slidably mounted in bore 36 and is biased towards detonator 40 by coil spring 42. Pin 41 is notched to provide a beveled surface 43 adapted to engage beveled surface 35 on 30 and normally retains firing pin 41 in its retracted or safe position. A safety clip 44 fitting in an annular groove 45 in head portion H provide a safety means to prevent accidental operation of the fuze.

In operation, the fuze is used in conjunction with a land mine (not shown) or like charge for destroying enemy personnel. This method of use is well known by Ordnance Personnel and no description is deemed necessary herein.

When a personnel load is applied to the pressure plate 9 at head H, the member 9 will be pushed downward against pressure of spring $15^a$ and carrying with it, selector bar 21. Bar 21 rotates clockwise due to interference of inclined surfaces 24 and 34. The bevel edge 24 of bar 21 will move off beveled edge 34 on release member and the turned up part 23 will engage the downwardly turned portion 33 of release 30. Upon release of the applied personnel load, the member 9 will move upward under pressure of spring $15^a$ and the upturned portion 23 of bar 21 engaging the downturned end of release member will pull it upwards to move beveled surface 43 off beveled surface 35 of firing pin 41 and release the pin to fire detonator 40 which in turn detonates a mine charge etc. (not shown)

If a load greater than a personnel load (such as a tank or like combat vehicle) is applied to the head H, the selector bar 21, will travel further down with the member 9. It will separate from the firing release and rotate in a clockwise manner owing to contact of pin 25 with lower track 20. The portion 11 of the pressure plate member 9 will bottom in recess 8 and no further movement will occur until the applied load is released. Upon release of the load, the member 9 will rise and the selector bar 21 will rotate in a counterclockwise manner due to pin 25 contacting the top part of upper track 19. The bar 21 will then assume its original position above release member 30, thus completing a non-functioning cycle and remains armed for the next load application.

Figure 2:
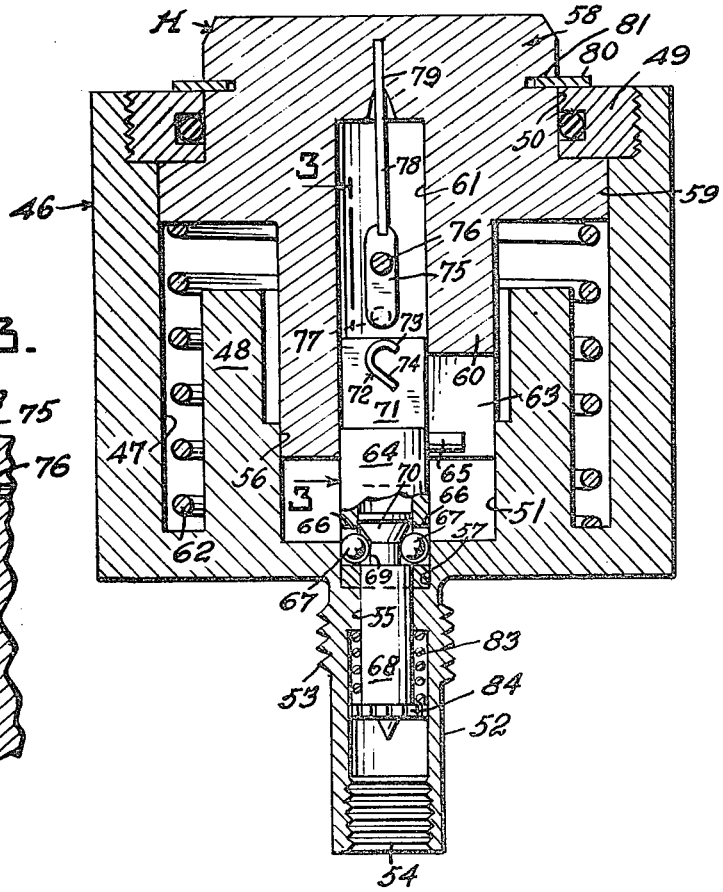
FIG. 2 is a view similar to FIG. 1 illustrating a modified form of the invention, and, FIG. 3 is a detail section taken along line 3—3 of FIG. 2 and looking in the direction of the arrows.
Figure 3:
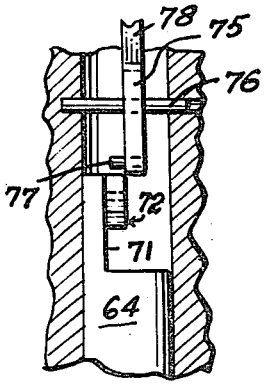

A modified form of the fuze is illustrated in FIG. 2. A fuze body indicated generally by 46 is provided with a cylindrical recess 47 and a coaxially disposed, upstanding cylindrical sleeve 48 integral with the floor of recess 47. A cover 49 is provided for closing recess 47 and has a central bore 50 therein. Sleeve 48 is provided with a coaxial bore 51. Body 46 defines at its lower end, a hollow cylindrical extension 52 of reduced diameter and is externally threaded as at 53 and internally threaded as at 54 for connection to a mine and detonator elements (not shown) and is provided with an internally reduced bore 55 for a purpose to be described later. Body 46 is further provided with coaxial bores 56 and 57, also for a purpose to be later described. A cylindrical pressure plate member indicated generally by 58 includes a head portion H which is slidable in bore 50, an intermediate portion 59 slidable in bore 47 and a downwardly extending reduced portion 60 slidable in bore 56. Member 58 is provided with a central upwardly extending bore 61 coaxially aligned with bore 57 and is of equal diameter therewith. Member 58 is normally biased upwardly in body recess 47 by a coil spring 62 disposed about portion 60 in recess 47 and biasing between the floor of recess 47 and intermediate portion 59. Reduced portion 60 is slotted as at 63. Fuze operating elements for the fuze are housed in bores 61 and extension 52 and comprise a tubular sleeve member 64 slidable in bore 57. Sleeve 64 is provided with a radially extending guide pin 65 adapted to ride in slot 63. The lower portion of sleeve 64 is provided with a pair of radial recesses 66 to receive a pair of detent balls 67. A firing pin 68 in slidably mounted in tubular sleeve 64 and in a reduced bore in extension 52. Firing pin 68 is provided at its upper end with a reduced annular groove 69 defining a conical upper portion 70.

The upper portion of sleeve 64 is solid and is cut out to provide a flat face 71 upon which is provided a firing pin release track generally indicated by 72 and defines a pair of downwardly inclining tracks, one short, 73 and one long, 74. A selector bar 75 is pivotally mounted in bore 61 immediately above tubular sleeve 64 by a transverse shaft 76, a selector bar pin 77 fixed to the lower portion of bar 75 extends at right angles to bar 75 to a substantial distance of the width of release track 72. A leaf spring or straight wire spring 78 normally retains bar 75 against rotation. Spring 78 is slip fit in the upper portion of member 58 as at 79, and is anchored in the upper portion of bar 75.

A safety clip 80 is provided to clamp in an annular groove 81 in member 58 to prevent accidental operation of the fuze.

The operation of the fuze is similar to the fuze of FIG. 1 and complete description thereof is not necessary. Upon pressure of a personnel load on H, selector bar pin 77 engages the outer surface of short track 73 of release track 72 and rotates counterclockwise until it snaps in a clockwise direction under track 73 by pressure of leaf spring 78. Upon release of the load, the bar 75 moves upward carring member 64 and firing pin 68. Firing pin 68 is held in sleeve 64 and compresses a coil spring 83 which is disposed about the pin and biases between the shoulder formed by reduced bore 55 and an enlarged portion 84 at its lower end. As the pin 68 rises balls 67, after clearing the bore 57 are pushed out into recess 51 by action of conical surface 70 and spring 83 and the pin is free to spring against a detonator (not shown) to fire the main charge of a mine. (also not shown).

When the applied load is greater than that of the personnel load (such as a tank or like vehicle) the selector bar 75 will continue on down passing tracks 73 and 74 on the right side to a point under the release track 72 when the member 58 bottoms in recess 51. Pin 75 is now in Vertical position due to action of leaf spring 78 and no further action will take place until release of the applied load. Upon release of the load, pin 77 will then be moved upward and on the left hand side of release track 72 by track 74 whereupon it assumes its original position above release track 72 as before the load was applied, thus completing a non-function cycle and is now ready and still armed for the next load application.

To use either of the two fuzes of the invention for a booby trap, normal booby trap techniques may be employed such as using a mine or other object of sufficient weight to act as a decoy. The weight is placed on the head H to move the selector bar and its pin into engagement with the firing pin release member. Upon lifting of the weight, the mechanism functions to detonate the main charge in the same manner as personnel load application.

It will be apparent from the foregoing description, that an anti-personnel mine fuze has been devised that provides a novel mechanism for discriminating between different loads or weights and will function upon application of a predetermined load but will not function upon application of any load greater than the predetermined load; an anti-personnel mine fuze mechanism that will remain armed after the application of a load greater than the functioning load and a fuze mechanism for a pressure-release type bobby-trap.

It is to be understood that the form of the invention herein shown and described, is to be taken as a preferred example of the same, and that various changes in the shape, size and arrangement of parts maybe resorted to, without departing from the spirit of the invention, or the scope of the subjoined claims.

What is claimed is:

1. In an anti-personnel mine fuze, a body member provided with a lower bore, an intermediate bore of less diameter than said lower bore and an upper bore of less diameter than said intermediate bore, said bores being in coaxial arrangement, an insert having a central recess disposed within said lower bore of said body, a spring-biased pressure plate member defining a head portion slidable in said upper bore and adapted to normally extend above the upper surface of said body, an intermediate portion slidable in said intermediate bore of said body and a downwardly extending hollow sleeve portion slidable in said recess in said insert, a detonator element mounted in a diametrical bore in said body and said insert, a spring biased firing pin having a notch in its upper side slidable in a counter bore in said insert and coaxial to said diametrical bore, an upstanding post having a notch in its upper end defining a pair of parallel, downwardly extending cam surfaces, integral to the bottom of said recess in said insert and extending upwardly and into said sleeve portion, a firing pin release member arranged for vertical sliding arrangement in said insert, the lower end of said release member normally engaging said notch in said firing pin and hold said pin in a retracted position, its upper end defining a downwardly turned hook portion, a selector bar pivotally mounted in said pressure plate member, a spring loaded detent pivotally connected at its lower end to the upper end of said selector bar and biasing against said pressure member at its upper end, said selector bar disposed normally above said post, and having its lower end terminating in an upwardly turned hook portion and a pin fixed to said selector bar adapted to ride on said cam surfaces on said post, said selector bar adapted to be rotated upon downward movement of said pressure plate member under a predetermined personnel load on said head portion of said pressure plate member to engage said hook portion thereon with said hook portion on said firing release member and upon release of said personnel load on said head portion and upward movement of said pressure plate member, to lift said release member upward and out of said notch in said firing pin to release said firing pin to fire said detonator, said pressure plate member moving downward to bottom in said insert upon application of a load heavier than said predetermined personnel load whereby said pin on said selector bar will ride on said lower cam surface and rotate said bar in a clockwise direction and apart from said release member and upon movement of said pressure plate member by release of said heavier load on said head portion of said pressure plate to ride on said upper cam surface and rotate said bar in a counter-clockwise direction to its position above said post.

2. In an anti-personnel mine fuze, a body member having a cylindrical recess therein, an upstanding concentrical sleeve in said recess, a spring-loaded pressure plate slidable in said body and sleeve, firing mechanism for said fuze comprising a firing pin release having a socket in its lower portion and a cut away upper portion defining a planar vertical face, a track member secured to said planar face defining a pair of downwardly inclining parallel upper and lower tracks, a spring loaded firing pin slidable in said body and received in said socket in said firing pin release, detent means normally locking said firing pin in said socket, a spring held selector bar pivotally mounted in said pressure plate member and disposed normally above said track member and a pin fixed with the lower end of said bar adapted upon downward movement of said pressure plate member and said bar upon application of a predetermined personnel load thereon to rotate in a counter-clockwise manner and snap under said upper track on said track member in a clockwise direction whereby upon release of said personnel load on said plate, said firing pin release and said firing pin will be lifted to free said detent locking members therefrom and release said firing pin, but upon application of a load heavier than said personnel load on said plate, said selector bar will rotate to move said pin thereon completely around said track member in a clockwise manner to complete a non-functioning cycle and rearmament of said fuze.

3. In an anti-personnel mine fuze, a body member having a central recess and a diametrical bore therein, a spring-loaded pressure member slidably mounted within said recess, a detonator element fixed in said diametrical bore, a spring-loaded firing pin for said element slidably mounted forwardly of said detonator in said diametrical bore, a release member having a turned downed upper end slidably mounted in said body, its lower end adapted to engage a notch in said firing pin and hold it in a cocked position, an upstanding post disposed in said recess, said post being cut at its upper end to define upper and lower inclined, parallel tracks, a selector bar pivotally mounted in said pressure member, a spring-loaded detent pivotally connected at its lower end to the upper end of said selector bar and biasing against said pressure member at its upper end, a pin integral with and extending from said bar adapted for engagement with said inclined tracks, whereby said selector bar, under application of a predetermined personnel load upon said pressure member, will move downward with said pressure member to position said turned up portion of the selector bar into engagement with the turned downed portion on the release member and lifting said release member when said pressure member rises upon removal of said predetermined load therefrom to release said firing pin, but upon application of a load heavier than said predetermined load upon said pressure member, said member will move downward to the bottom in said recess, said selector bar being rotated in a clockwise direction upon contact of said pin with the lower portion of lower track, and said selector bar rotating in counter clockwise direction upon upward movement of said pressure member, said pin on said selector bar, upon removal of said heavier load, contacting the upper portion of said track, whereby said pressure member moves upwardly to reset said fuze.

* * * * *